US006826862B2

(12) United States Patent
Nelson et al.

(10) Patent No.: US 6,826,862 B2
(45) Date of Patent: Dec. 7, 2004

(54) REDUCED PROFILE INTERLOCKING PLASTIC DISPLAY

(75) Inventors: Kenneth W. Nelson, c/o Tech Products, Inc. 1 Edgewater Plz., Suite 218, Staten Island, NY (US) 10305; Stanley L. Roggenburg, Middletown, NJ (US); Anthony N. Fokas, Brooklyn, NY (US)

(73) Assignee: Kenneth W. Nelson, Staten Island, NY (US)

( * ) Notice: Subject to any disclaimer, the term of this patent is extended or adjusted under 35 U.S.C. 154(b) by 0 days.

(21) Appl. No.: 10/321,330

(22) Filed: Dec. 17, 2002

(65) Prior Publication Data

US 2004/0111940 A1 Jun. 17, 2004

(51) Int. Cl.[7] ..... G09F 1/00
(52) U.S. Cl. ..... 40/616
(58) Field of Search ..... 40/584, 615, 616, 40/618

(56) References Cited

U.S. PATENT DOCUMENTS 3,973,344 A * 8/1976 Frankel ..... 40/706
4,835,890 A * 6/1989 Nelson et al. ..... 40/616
5,265,364 A 11/1993 Nelson et al. ..... 40/616
5,423,155 A * 6/1995 Bauer ..... 52/506.01
5,536,545 A * 7/1996 Condon et al. ..... 428/42.1

* cited by examiner

*Primary Examiner*—S. Joseph Morano
*Assistant Examiner*—Robert J. McCarry, Jr.
(74) *Attorney, Agent, or Firm*—Cohen, Pontani, Lieberman & Pavane

(57) ABSTRACT

An interlocking plastic display has a first member formed as a first shot of an injection molding process. The first member includes a submerged grid system which is formed only where necessary to connect otherwise unconnected portions of the top layer or to stabilize the top layer where openings may be relatively large. An array of spacers is formed beneath those portions of the top layer having material therein, to space the top layer from the bottom of the mold used during a second shot of injection molding. No spacers are formed beneath completely spaces of the top layer in which no material is disposed. The arrangement of the spacers provides an open area underneath the top layer, so that the second member may be formed in the second shot and allows the second shot material to flow around the spacers on the bottom of the mold to interlock the two members.

30 Claims, 5 Drawing Sheets

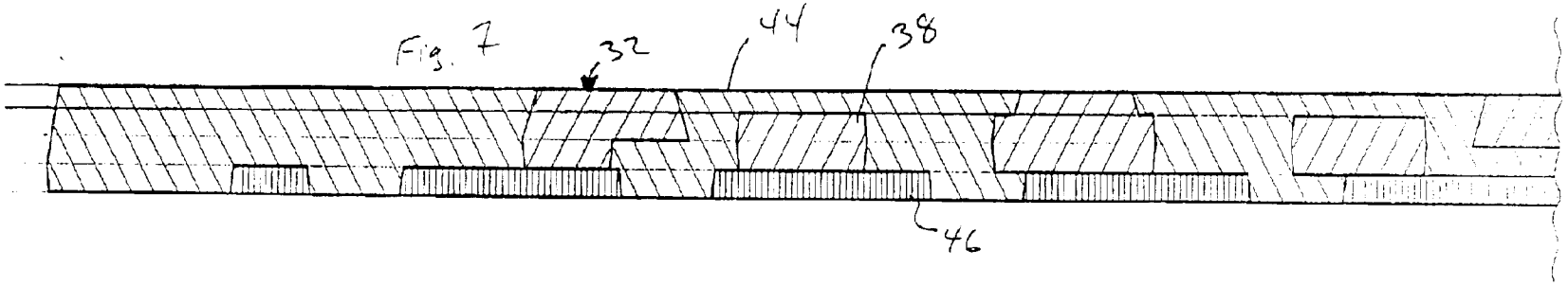
Fig. 7
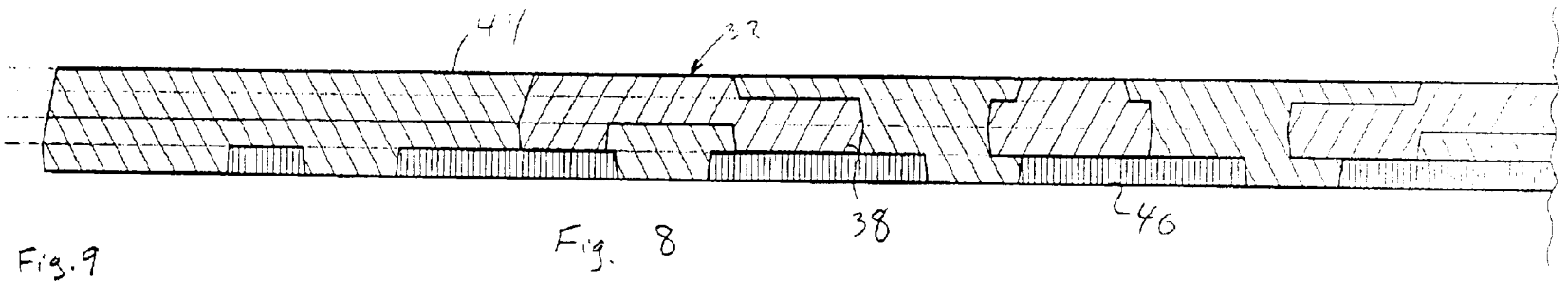
Fig. 8
Fig. 9
INSERT 32
FIRST MEMBER 44
SECOND MEMBER 46

REDUCED PROFILE INTERLOCKING PLASTIC DISPLAY

BACKGROUND OF THE INVENTION

1. Field of the Invention

This invention is directed to the field of displays, and, more particularly, to an interlocking plastic display using a submerged grid system to reduce the overall thickness of the display.

2. Background of the Prior Art

Many different types of display devices are in common use, such as, for example, name tags, outdoor signage, advertising displays, and markings for utility poles and underground cables. Despite the different applications and uses, purchasers of such devices have some common criteria for deciding what type of display to purchase, and chief among them is the price of the display. In some applications where the display is used in harsh conditions (such as outdoor advertising, or in tagging underground cables) or is worn on a daily basis, durability is a key concern.

With these concerns in mind, U.S. Pat. No. 4,835,890 (the disclosure of which is hereby incorporated by reference) discloses an interlocking plastic display in which a first plastic member is injection molded in the shape of a desired display, in a first injection shot. A second plastic member of a contrasting color is then formed about the first member, also by injection molding, so that the two members mate and interlock to form a rugged display usable in even the harshest environments. In this display, the first member of the interlocking plastic display is a display member having an upper indicia portion and a lower locking portion. The lower portion of the first member comprises a series of open grooves or apertures extending along the width of the display. The indicia portion sits atop the universal lower locking portion, and is joined thereto. The grooves of the lower locking portion are formed with a stepped cross section, so that the second, background, member of the display may be formed around and in the grooves, thereby permitting the two members to interlock.

This display has worked well, generally, but after some experience with manufacture and production of such displays, some problems were observed. Under certain conditions, the display sometimes warped during use along the lines forced by the open grooves, especially in larger signs, which necessitated additional production costs to rectify. On occasion during manufacture, there was an uneven flow of material in the two-shot injection process.

An improved interlocking plastic display is disclosed in U.S. Pat. No. 5,265,364 (the disclosure of which is also incorporated by reference). In this improved display, the display is made of a three-layered display member: an upper indicia layer, a middle universal grid and a lower spacing layer. The concept was that the spacing layer would have a reduced overall volume of material compared to the middle grid layer. The large amount of open volume beneath the grid layer, between the individual spacers in the spacer layer would facilitate the flow of the second shot background material around the first shot display portion, since the middle universal grid would allow the material forming the background portion to flow more evenly through the entirety of the display. Since the lower spacer portion had a smaller overall profile, the background material would be able more easily to flow above and below the grid to permit the flow of more material on either side of the grid, thereby providing a more secure interlock. Although this display is fully functional, it is quite thick, about 0.240" (appx. 6 mm), making the display somewhat costly to manufacture, and somewhat difficult to manipulate in certain applications (for example, in an application in which slight bending of the display is desired, as in the case of a tag on a utility pole). The manufacturing process is also somewhat involved, since it employs a three-layered first member with a universal grid and spacer system. It was considered important that the grid include spacers at every possible node of the intermediate grid, to ensure that the top surface of the indicia presses evenly against the face of the mold in which the first member is placed during the second shot, to prevent "flashing" or leakage of plastic of the second shot over the top of the first member.

There is thus a need in the art for a still further improvement in the field of interlocking plastic display signs, permitting thinner profile displays having improved interlocking and manipulability, and which are easier to manufacture.

SUMMARY OF THE INVENTION

It is an object of the invention to provide an interlocking plastic display having a reduced thickness compared to prior art interlocking plastic displays.

In accordance with a preferred embodiment of the invention, an interlocking plastic display has a first member formed as a first shot of an injection molding process. The first member has a top layer which includes a submerged grid system. The grid system is formed only where necessary to connect otherwise unconnected portions of the top layer or to stabilize the top layer where openings may be relatively large. An array of spacers is formed beneath those portions of the top layer having material therein, to space the top layer from the bottom of the mold. No spacers are formed beneath completely open spaces of the top layer. The arrangement of the spacers provides an open area underneath the top layer, so that the second member may be formed in a second injection molding shot and allows the second shot material to flow around and between the spacers on the bottom of the mold. The top of the top layer contacts one side of the mold during the second shot, and the bottoms of the spacers contact the bottom of the mold, so that the first member is maintained in place during the second shot, and thereby prevents slippage of the first member during the second shot. This avoids flashing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals delineate similar elements throughout the several views:

FIG. 7 is a cross-section of a portion of the insert of FIGS. 5 and 6, taken along lines VII—VII thereof;

FIG. 8 is a second cross-section of a different portion of the insert of FIGS. 5 and 6, taken along lines VIII—VIII thereof; and FIG. 9 is a key showing the shading used in the cross-sections of FIGS. 7 and 8.

DETAILED DESCRIPTION OF THE PRESENTLY PREFERRED EMBODIMENTS

Figure 1:
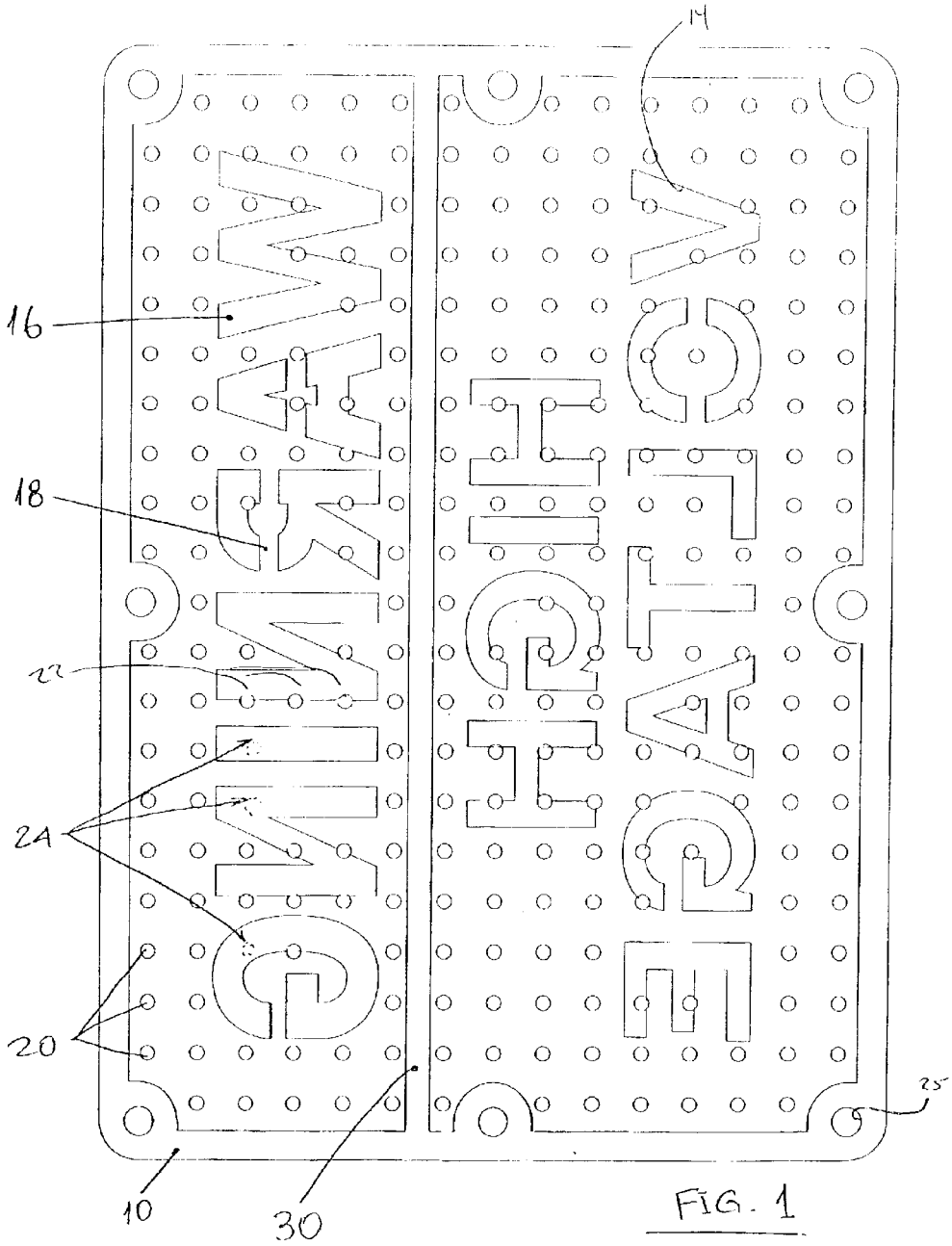
FIG. 1 is a bottom plan of the first member of a preferred embodiment of the invention.
Figure 2:
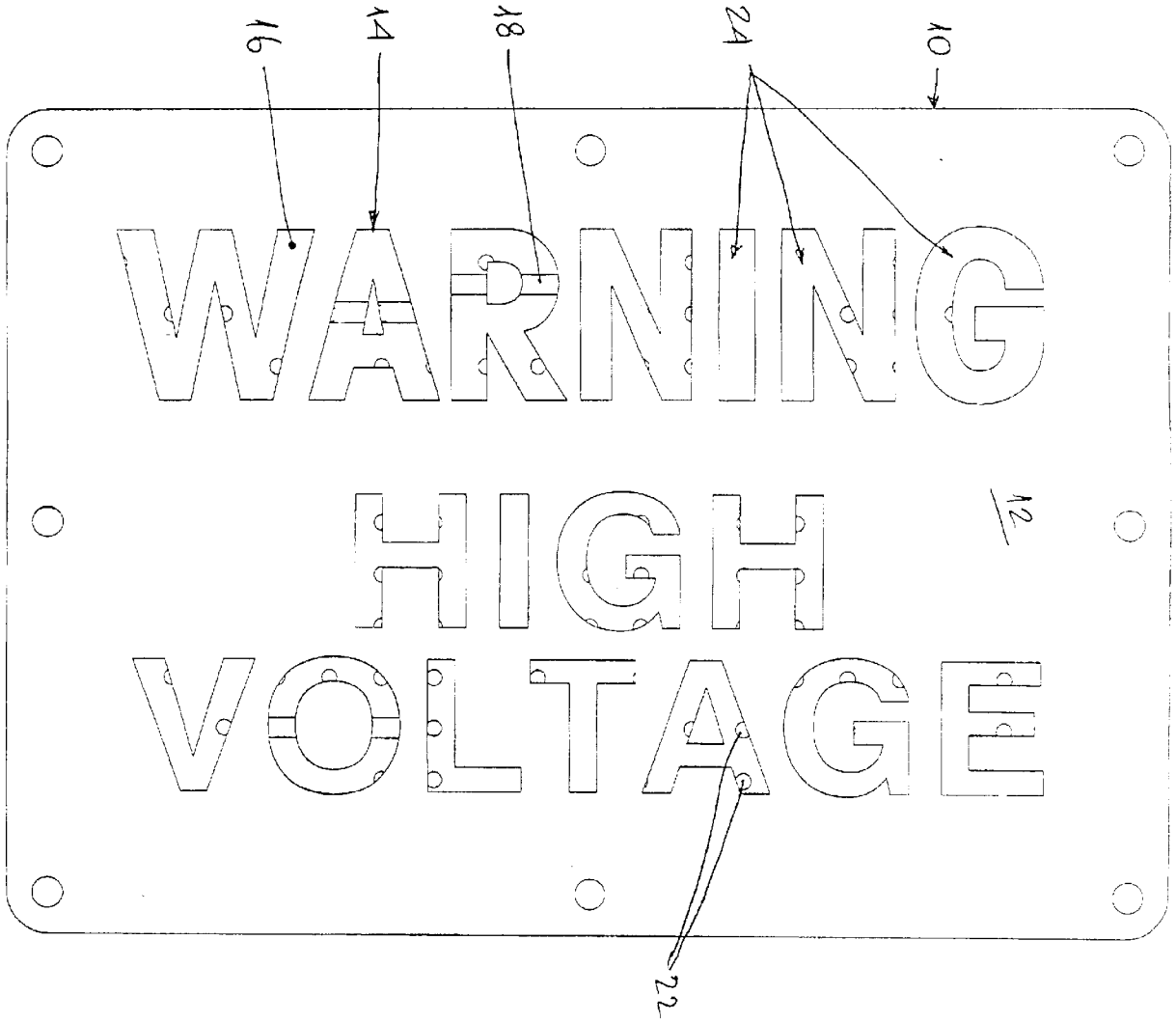
FIG. 2 is a top plan view of the first member of the embodiment of FIG. 1.
Figure 3:
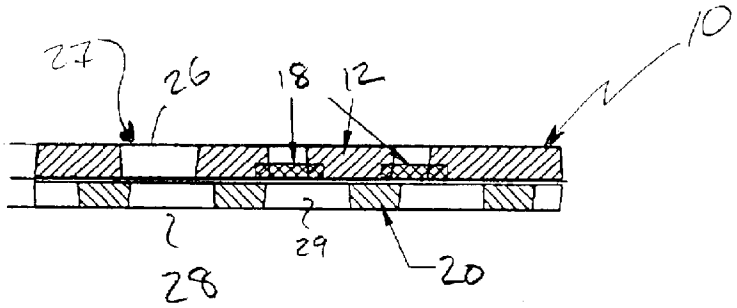
FIG. 3 is a cross section of a portion of the first member of FIGS. 1 and 2, showing its interlocking with the second member of the preferred embodiment.

The interlocking plastic display of a preferred embodiment of the invention comprises at least two interlocking plastic members. A first member 10 is shown in FIGS. 1 to 3. First member 10 is formed of a thermoplastic material, such as, for example, polypropylene. First member 10 is preferably formed through injection molding. In conventional fashion, two opposed molds (not shown) having desired configurations are placed opposite one another, leaving a void therebetween. The thermoplastic material is then injected into the void to form first member 10.

The top mold is configured to produce a top layer 12 of first member 10, as seen in FIG. 2. Top layer 12 of first member 10 includes indicia 14 which are desired to be displayed. In the illustrative example, the display includes the words "WARNING HIGH VOLTAGE" as indicia 14. Top layer 12 is preferably approximately 0.090" (2.3 mm) thick. In the illustrated embodiment, top layer 12 is formed as a solid background with openings or voids 16 configured in the shape of desired letters so that the letters themselves will be formed by the second shot of material (as will be described presently). It is possible, however, to form top layer 12 as the indicia themselves, so that the second shot will make up the background. This is a mere matter of design choice, and, in fact, the top layer may include both background in some places and indicia in others, in the same shot, switching the colors of the indicia and the background, as may be desired by the user to satisfy the graphical needs of the application for which the particular display is intended.

Where top layer 12 includes large indicia (e.g. large letters), or large spaces, it may be desired to join opposite sides of voids 16 by bridging material, so that voids 16 are not placed out of alignment during the second shot of the molding process. In the above described U.S. Pat. Nos. 4,835,890 and 5,265,364, the indicia are held in place by use of the standard or universal grids placed underneath the indicia layer, and formed as part of the bottom mold of the two mold process, thereby resulting in a somewhat thick display.

In the present invention, however, top layer 12 includes a submerged grid system, which only joins discontinuous portions of top layer 12. The submerged grid system takes the form of reduced thickness portions 18 (see the cross-section of FIG. 3). Reduced thickness portions 18 are preferably approximately 0.050" (1.3 mm) thick. The bottoms of reduced thickness portions 18 are preferably aligned with the bottom of top layer 12, so that the tops of reduced thickness portions 18 are lower than the top of top layer 12 (as best seen in FIG. 3). In this fashion, when the second step of injection molding is performed, the second material will flow over the top of reduced thickness portions 18, and obscure reduced thickness portion 18 from view, leaving only the clean and properly arranged outline of the desired indicia and/or background of top layer 12 visible. In a preferred embodiment, reduced thickness portions 18 are arranged as substantially linear bridges across the backs of some of the openings 16 in indicia 14, and have a slightly tapered profile (smaller at the top and larger at the bottom) to permit ease of extraction from the mold upon completion.

First member 10 further includes a first locking means, such as an array of spacers 20 on the back thereof. In the preferred embodiment, spacers 20 are arranged in a standard array, such as the rectilinear array shown in the figures. Spacers 20 may be formed in any desired shape, such as round or square of a uniform shape along their length or tapered, having a larger diameter at the tops thereof (which meet the bottom of top layer 12) than at the bottom, and either stepped or conical for ease of removal from the mold completion of the first injection molding step. The use of spacers having an upper (larger) diameter of approximately 0.020" (0.6 mm) and a height of approximately 0.050"–0.080" (1.3 mm-2.0 mm), preferably 0.060" (1.5 mm), are currently believed to provide optimal flow of material during the second shot.

Spacers 20 may be formed by a universal bottom mold, having a desired generic array of voids therein. In this way, the cost of manufacture is reduced, since only the top mold needs to be manufactured separately. The submerging of the grid layer into top layer 12 removes it from the bottom mold. This shift has a profound effect on the actual configuration of the array of spacers 20 because not every potential spacer 20 is actually formed. During the first injection step, those portions of the top mold which represent the voids into which the second shot material will flow, reach the upper surface of the lower mold, thereby closing off the portions of the lower mold that provide access to the spacers which would be positioned beneath voids 16. This means that no spacer will be positioned underneath voids 16. For spacers 22 which only lie partially beneath voids 16, and partially beneath the formed portions of top layer 12, the first material will flow into the apertures for such spacers in the bottom mold, leaving some spacers 22 partially visible from the top of first member 10 before the second injection molding step (as seen in FIG. 2).

Arrows 24 (FIG. 1) point to dotted lines which indicate some places where spacers 20 are missing from the array of spacers. For example, a regular array of spacers 20 would have three spacers in each of the open areas in the "I" and the second "N" in "WARNING". These spacers are never formed. Spacers 22 are examples of spacers formed party underlying voids 16, and partly underlying top layer 12.

Once first member 10 is formed and cured (in conventional fashion) it is placed into a further pair of opposed molds each having completely blanking sides. The two second shot molds are spaced apart by the thickness of first member 10, so that the top of top layer 12 contacts the top of the top second shot mold, and the bottoms of spacers 20 contact the bottom of the bottom second shot mold. Guide holes 25 may be utilized to assist in positioning first member 10 in the second shot molds, in conventional fashion.

During the second shot, a second material, having color different from, and contrasting to, the first material is injected into the opposed second shot molds, and permitted to flow into all open spaces, which means that the material fills all interstitial spaces between spacers 20, and up into voids 16, thereby forming a second member 27. Second member 27 interlocks with first member 10 to form an interlocking plastic display of two contrasting colors with high durability and ease of manufacture. The second material forms a second locking means 29 (FIG. 3) as part of second member 27 which mates with spacers 20 to hold the first member 10 and second member 27 together. Second member 27 will have a top surface 26 generally aligned with the top of top layer 10, and a bottom surface 28 generally aligned with the bottom of spacers 20, so that the overall display will have generally flat top and bottom surfaces.

In a secondary embodiment, one or more dams 30 (FIG. 1) may be provided on the rear of top layer 12, to permit the use of two or more different contrasting colors of second member material, if the application calls for the use of three or more colors of display. In this embodiment, dam(s) 30 limit the flow of the second material to one side or the other thereof, so that the side which is unfilled by the second shot may be filled by a third shot of a third color chosen to contrast with the first and second materials. These two different colors may be injected simultacously through different sprues (the openings through which the molten material flows) located on opposite sides of dam 30, to reduce the processing time.

Figure 4:
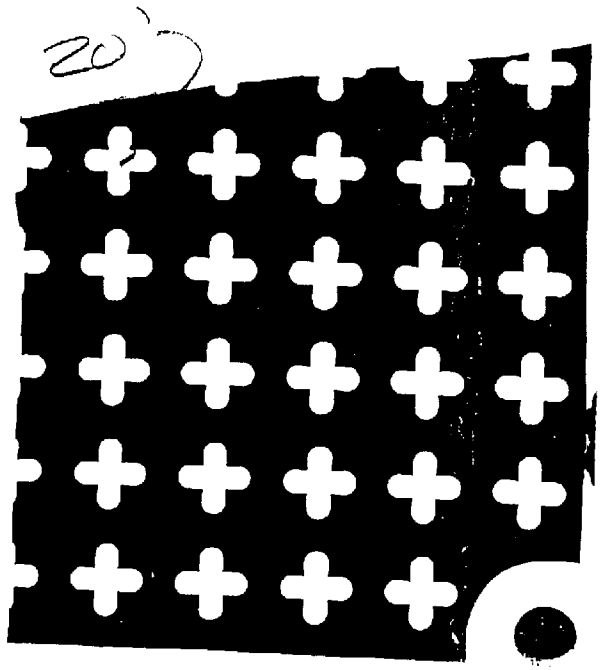
FIG. 4 is a bottom view of a portion of a secondary embodiment of the inventive design, showing spacers with a different configuration.
Figure 6:
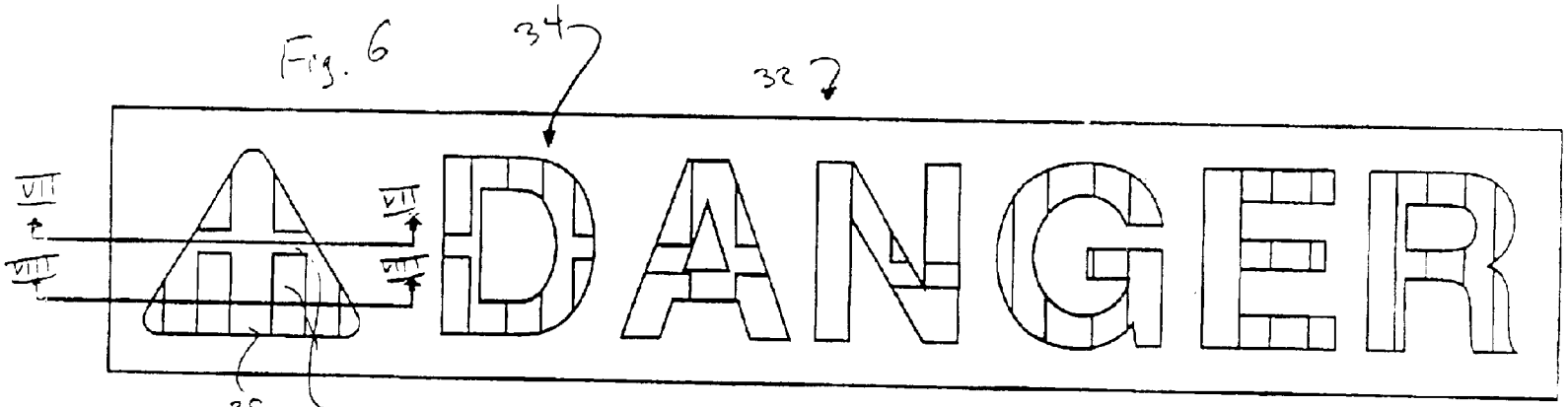
FIG. 6 is a top plan of the insert of FIG. 5.
Figure 5:
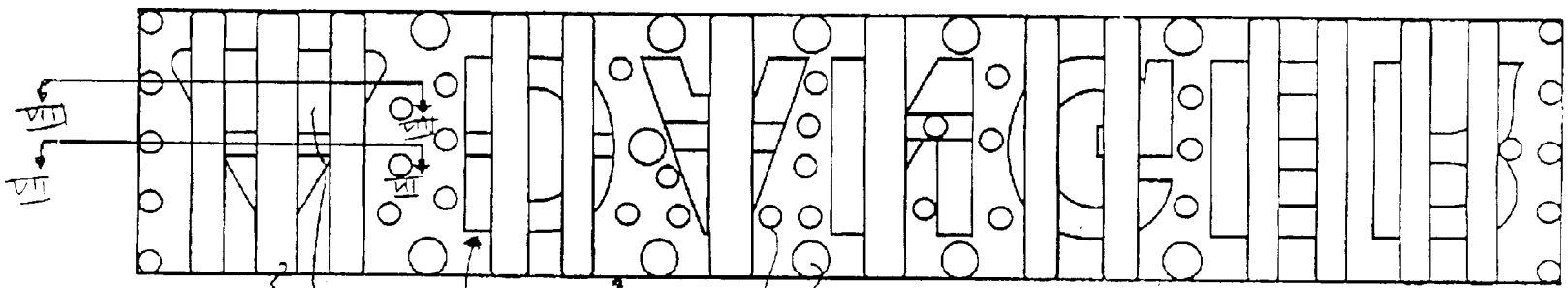
FIG. 5 is a bottom plan of an insert used in a third embodiment of the invention.

In a further embodiment, spacers 20' may be formed in a different shape, such as "+" (cross) shapes, as shown in FIG. 4.

In this manner, however, a simple and inexpensive interlocking plastic display may be produced. The overall thickness of the inventive display is in the range of 0.150" (3.8 mm), compared to the 0.230" (5.8 mm) previously realized. The reduction in thicknesses provides a significant reduction in the cost of materials, and provides a display with improved manipulability than heretofore known.

A still further embodiment of the invention is shown in FIGS. 5 to 8.

One useful feature of the invention is its flexibility of use in varying applications having different indicia/backgrounds, and the ease of changing the mold setups from use to use, reducing the time (and therefore cost) associated with making different displays. A still further reduction in time may be realized by recognizing that many applications call for the use of common portions of the ultimate display.

Many displays have identical portions such as, for example, WARNING, CAUTION, DANGER, etc., and often it may be desired or required to use special colorations for these portions: red for WARNING, yellow for CAUTION, etc. The colors used for these portions must contrast with the other two colors used in the display, mandating the use of the three-color display discussed above. In these situations, however, the common portions (e.g., WARNING) may be manufactured ahead of time in smaller molds, and kept in inventory, reducing the overall time in preparing the final product which includes the common portion. While adding slightly to up-front manufacturing costs, preparing an inventory of these commonly used portions in bulk may result in significant savings in the ultimate production of the signs, since an order of signs using the WARNING common portion (for example) is far more expensive to manufacture in small quantities than if it may be filled using a standardized common insert and then simply a two-shot forming process (rather than a three-shot forming process) when needed to fill the small order.

This embodiment may be realized in the following fashion:

First, an inventory of small common portions is made. In one embodiment, the common portion molds will be smaller than the molds used for the overall sign of the larger final displays, which itself makes them easier to handle and therefore cheaper to produce. The common portions formed in this fashion are illustrated in FIGS. 5 to 8. FIG. 9 is a key for the shading used in FIGS. 7 and 8.

An insert 32 is formed in much the same fashion as first member 10 is formed in the preferred embodiment. Insert 32 is configured in the form of a desired indicia 34 or background, such as "DANGER". In this configuration, insert 32 may be red, to indicate DANGER. Indicia 34 would have lettering formed of voids 36, and discontinuous sides of indicia 34 are joined by reduced profile grid portions 38. Spacers 40, 42 are formed on the bottom of indicia 34.

Insert 32, however, has some differences from first member 10.

First, it is smaller in thickness. The entire insert 32 is intended to sit on the top of the bottom mold during the standard first shot of the molding process of the preferred embodiment, so the total thickness of insert 32 is the same as the thicknesses of top portion 12 of first member 10, i.e. approximately 0.090" (2.3 mm) is preferred for this embodiment.

Second, since insert 32 is itself standardized, it is not necessary to accommodate a standardized array of spacers and/or grid system underneath indicia 34. Thus, grids 38 which hold together discontinuous sides of indicia 34 may extend all the way to the bottom of insert 32, and part way to the top thereof, leaving only clearance on the top thereof (see FIG. 7). Furthermore, spacers 40 may be designed in a fashion other than a standardized rectilinear array as is preferred (but not required) for the preferred embodiment described above, since the spacing and positioning of indicia 34 of insert 32 is constant. Each insert 32 may therefore have a different arrangement of the locking portions of the bottom thereof, by having a combination of spacers 40, 42 and submerged grids 38 which will permit the flow of material about insert 32 during its subsequent use, as will be described presently.

Third, since the array of spacers 40, 42 is customized for each insert, it may include spacers of different sizes or shapes (compare spacer 40 to spacer 42).

Fourth, also due to the customization of the array of spacers 40, 42, no partial spacers are visible from the top of insert 32 after formation.

Once insert 32 is formed and cured, it may be placed in inventory until needed. To make a display using insert 32, the user places an insert 32 into a mold identical to the first shot mold of the preferred embodiment, except that the top mold, rather than being shaped to form the entire indicia to be disposed on the top of the resultant display, includes only the desired indicia not already part of insert 32.

Insert 32 is placed in the first shot mold in the desired location. Insert 32 may be held in place in any one of a variety of ways. For example, vacuum holes placed in the top of the top mold may secure insert 32 in place. Alternatively, selected ones of spacers 40, 42 of insert 32 may be positioned over the holes in the bottom mold which will form selected ones of spacers 20 in first member 10 of the display. These selected ones of spacers 40, 42 may then be made deeper than the rest of spacers 40, 42, so that they will extend into the holes for the selected spacers 20, and thereby provide means for securing insert 32 in place during the first (post-insert) shot of the injection molding process using insert 32. The pressure of the mold will hold insert 32 in place, and prevent flashing of the material of first member over tile top of insert 32.

After a first member 44 (which now includes insert 32) is formed and cured, it is placed in a mold identical to that of the second mold used to form the display of the preferred embodiment, i.e. completely smooth on either side, and a second shot of material is injected, thereby forming a second member which mates with both first member 44 and any opening left in insert 32.

In some applications, it may be preferred that at least a portion of indicia 34 be of the same color as the second shot (whether that be indicia or background of the display as a whole). In such applications, the bottom of insert 32 may include dams similar to dam 30 (not separately shown in FIG. 6) to allow for the flow of the proper color material into voids 36, as desired. This is purely a matter of design choice.

Since inserts 32 are smaller than full-sized displays, it is also possible to form several of them at the same time, using a standard size mold, rather than using smaller molds to make them individually.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve substantially the same results are within the scope of the invention. Moreover, it should be recognized that structures and/or elements and/or method steps shown and/or described in connection with any disclosed form or embodiment of the invention may be incorporated in any other disclosed, described or suggested form or embodiment as a general matter of design choice. It is the intention, therefore, to be limited only as indicated by the scope of the claims appended hereto.

What is claimed is:

1. A display comprising:

a first member comprising:

a top layer extending from a top surface of said first member towards a bottom surface of said first member, and having a thickness less than a thickness of said display, said top layer being configured in the shape of at least one of a first indicia and a first background, and a first locking means disposed beneath a bottom surface of said top layer, and including a plurality of spacers, each of said spacers being at least partly disposed beneath and in direct contact with said bottom surface of said top layer, at least some of said spacers extending to said bottom surface of said first member, and also extending in a direction substantially parallel to said bottom surface of said first member to an extent less than substantially completely across a width of said display and a breadth of said display; and a second member configured to mate with said first member, and forming at least one of a second indicia and a second background, said second member comprising second locking means configured to interlock with said first locking means, said second member having a color different from a first color of said first member.

2. The display of claim 1, wherein at least one of said spacers partially underlies an area of said top portion in which no material forming said top layer is disposed.

3. The display of claim 1, wherein at least a portion of said spacers have substantially identical shapes.

4. The display of claim 3, wherein at least a portion of said spacers, have a larger cross-sectional proximate said bottom portion of said top layer than proximate said bottom of said display.

5. The display of claim 4, wherein at least a portion of said spacers are frusto-conical in shape.

6. The display of claim 3, wherein at least a portion of said spacers are substantially "+" shaped in cross-section.

7. The display of claim 3, wherein a portion of said spacers are substantially circular in cross-section.

8. The display of claim 1, wherein said spacers are arranged in an array.

9. The display of claim 8, wherein said array is substantially rectilinear.

10. The display of claim 8, wherein there are gaps in said array where a spacer would be located beneath an area of said top layer in which no material forming said top layer is disposed.

11. The display of claim 1, wherein said top layer further comprises at least one portion of reduced thickness to connect two discontinuous portions thereof.

12. The display of claim 11, wherein said portion of reduced thickness does not extend all the way to said top surface of said first member.

13. The display of claim 12, wherein said portion or reduced thickness includes a substantially planar bottom, and said bottom of said portion of reduced thickness is co-planar with said bottom surface of said top layer of said first member.

14. The display of claim 1, wherein said top surface of at least one of said first and second members is substantially planar.

15. The display of claim 14, wherein said top surfaces of both said first member and said second member are substantially planar.

16. The display of claim 15, wherein said top surfaces of said first and second members are not substantially co-planar.

17. The display of claim 15, wherein said top surfaces of said first and second members are substantially co-planar.

18. The display of claim 1, wherein said bottom surface of at least one of said first and second members is substantially planar.

19. The display of claim 18, wherein said bottom surfaces of both said first member and said second member are substantially planar.

20. The display of claim 19, wherein said bottom surfaces of said first and second members are not substantially co-planar.

21. The display of claim 19, wherein said bottom surfaces of said first and second members are substantially co-planar.

22. The display of claim 21, wherein at least some of said spacers extend to said bottom surface of said first member, and have bottoms lying in said plane of said bottom surface of said first member.

23. The display of claim 1, further comprising a third member having a third color different from that of said first and second members, and forming at least one of a third indicia and a third background, said third member having a third locking means for interlocking with a portion of said first locking means.

24. A display comprising:

a first member comprising:

a top layer extending from a top surface of said first member towards a bottom surface of said first member, and having a thickness less than said thickness of a display, said top layer being configured in the shape of at least one of a first indicia and a first background and having a portion of reduced thickness to connect two discontinuous portions thereof, said portion of reduced thickness having a top surface disposed below said top surface of said top layer, and a first locking means (disposed beneath a bottom surface of top layer, and including a plurality of substantially identical spacers arranged in an array, each of said spacers being at least partly disposed beneath and in direct contact with said bottom surface of said top layer, at least some of said spacers extending to said bottom surface of said first member, and also extending in a direction substantially parallel to said bottom surface of said first member to an extent less than substantially completely across a width of said display and a breadth of said display; and a second member configured to mate with said first member, and forming at least one of a second indicia and a second background, said second member comprising second locking means configured to interlock with said first locking means, said second member having a second color different from said first color of said first member.

25. A method of manufacturing a display comprising the steps of:

forming a first member of a first material, said first member having at least one of an indicia and a background on a top layer thereof, and a first locking means having a plurality of spacers disposed beneath said top layer, said spacers extending from said bottom of said display to said bottom of said top layer and being arranged in an array, said array underlying portions of said top layer having said first material therein, said spacers extending less than substantially completely across said width and said breadth of said display, and forming a second member of a second material having a color different than a color of said first member, said second member filling in any spaces in said first member in which no material is disposed between said top and bottom surfaces of said display not occupied by said first material, and including a second locking portion which mates with said first locking portion of said first member, thereby interlocking said first and second members.

26. The method of claim 25, further comprising forming omitting spacers in positions in said array which underlie portions of said top layer not containing said first material.

27. The method of claim 25, further comprising forming reduced thickness portions in said first member to join otherwise discontinuous portions of said top layer thereof.

28. The method of claim 25, further comprising forming an insert, said insert having a width less than a width of said display, a breadth smaller than a breadth of said display, a thickness extending from a top of said insert to a bottom of said insert being substantially equal to the distance from a top of said first member to a bottom of said top layer of said first member, said insert further including at least one of a second indicia and a second background and being formed of a color different from at least one of the color of said first member and said second member, said indicia further having third locking means disposed below said top of said insert and extending to said bottom of said insert.

29. The method of claim 28, wherein said step of forming said first member is performed after said step of forming said indicia, and said first member is formed so that at least a portion thereof interlocks with at least a portion of said third locking portion of said insert.

30. The method of claim 28, wherein a portion of said third locking means is formed to extend to said bottom of said display.

* * * * *